United States Patent [19]

Ito et al.

[11] 4,438,918

[45] Mar. 27, 1984

[54] ORIGINAL ALIGNING DEVICE

[75] Inventors: Yoshio Ito, Kanagawa; Takeshi Ikeda, Yokohama; Hiroaki Matsumoto, Kawasaki; Minoru Ogata, Yokohama, all of Japan

[73] Assignee: Canon Kabushiki Kaisha, Tokyo, Japan

[21] Appl. No.: 468,809

[22] Filed: Feb. 28, 1983

Related U.S. Application Data

[63] Continuation of Ser. No. 220,045, Dec. 5, 1980, abandoned.

[30] Foreign Application Priority Data

| | | | |
|---|---|---|---|
| Apr. 20, 1979 | [JP] | Japan | 51-48655 |
| Jun. 12, 1979 | [JP] | Japan | 51-73694 |
| Oct. 8, 1979 | [JP] | Japan | 51-129781 |
| Oct. 23, 1979 | [JP] | Japan | 51-136727 |
| Oct. 24, 1979 | [JP] | Japan | 51-137231 |

[51] Int. Cl.[3] ..... B65H 9/16

[52] U.S. Cl. ..... 271/251; 271/273; 271/265; 235/485

[58] Field of Search ..... 271/251, 265, 245, 246, 271/272, 273, 274, 264; 235/485

[56] References Cited

U.S. PATENT DOCUMENTS

| | | | |
|---|---|---|---|
| 3,370,844 | 2/1968 | Roberts | 271/265 X |
| 3,630,518 | 12/1971 | Street | 271/251 |
| 3,703,626 | 11/1972 | Shanrock | 271/251 X |
| 3,908,986 | 9/1975 | Bleau | 271/251 X |
| 4,085,931 | 4/1978 | Szeluga et al. | 271/265 |
| 4,104,105 | 8/1978 | Rayfield et al. | 271/251 X |
| 4,125,255 | 11/1978 | Stovall et al. | 271/251 |
| 4,147,339 | 4/1979 | Shiina | 271/251 X |

FOREIGN PATENT DOCUMENTS 49-41597 11/1974 Japan .

OTHER PUBLICATIONS

Souba, C. H., "Document Feed Device", *IBM Tech. Disc. Bull.*, vol. 14, No. 7, Dec. 1971, p. 2181.

Rogers, J. C., "Caster Drive and Aligning Mechanism", *IBM Tech. Disc. Bull.*, vol. 16, No. 9, Feb. 1974, p. 2960.

Buddendeck, M. H., "Automatic Side Registration for Finisher", *Xerox Disc. Journal*, vol. 3, No. 6, Nov./Dec. 1978, pp. 413–414.

*Primary Examiner*—Bruce H. Stoner, Jr.

*Assistant Examiner*—James E. Barlow

*Attorney, Agent, or Firm*—Fitzpatrick, Cella, Harper & Scinto

[57] ABSTRACT

A device for preventing a sheet-like original, when conveyed to a position for reading the image information of the original, from being conveyed to the reading position in an oblique condition with respect to a proper direction. When the original 14, 25, 81 is conveyed along a guide surface 5 while being held between a ball, 8, 23, 33, 44, 51, 71, 75 and an opposed member 6, 22, 29, 31, 50, 70, 76, this device conveys the original at a certain angle with respect to the guide surface, thereby automatically correcting to a proper direction the original being obliquely fed.

10 Claims, 25 Drawing Figures

ORIGINAL ALIGNING DEVICE

This application is a continuation of application Ser. No. 220,045 filed Dec. 5, 1980 now abandoned.

TECHNICAL FIELD

This invention relates to an original aligning device for automatically aligning the leading end edge of a sheet-like original with respect to a reading portion when the original is conveyed to the reading portion, and particularly to an original aligning device for automatically correcting to a proper direction the conveyance direction of the original which tends to be obliquely conveyed.

BACKGROUND ART

Some of apparatus having the function of reading an original such as copying machines, facsimile apparatus, etc. have a mechanism for automatically conveying the original and a mechanism for automatically aligning the leading end edge of the original being conveyed. Some of the aligning devices of these prior art mechanisms move movable guide plates provided at one or both sides of an obliquely conveyed original to align such original before it reaches a reading portion, and force the sides of the oblique original by the guide plates, thereby correcting the conveyance direction of the original. Also, as a high-degree aligning device, it would occur to mind to detect the condition of an original being conveyed and move conveyor rollers to a desired position in the direction of their rotational axis as required or rotate the rollers until the leading end edge of the original assumes a desired state.

The above-described mechanisms are complicated in construction and, where the guide plates and the rollers are large in size, the original to be corrected must have a predetermined thickness or self-supporting strength, and it is difficult to cause these mechanisms to effectively act for very thin originals such as air mail paper. Also, mechanisms which do not have the above-described aligning devices are cumbersome to use because the operator of the copying machine or the like must convey an original while confirming the position of the original relative to the guide plate or guide line.

It is therefore the object of the present invention to provide an original aligning device which can align thin originals by a simple construction.

DISCLOSURE OF INVENTION

The aligning device of the present invention has a ball having no particular rotational axis which, when it receives a drive, rotates following the movement of the drive source side, an opposed member opposed to the ball for holding a sheet original between it and the ball, and drive means for driving the ball or the opposed member to convey the sheet original in the direction of an acute angle with respect to a guide surface provided at right angles with an original reading portion in order to convey the sheet original while aligning the leading end edge thereof with respect to the reading portion when the sheet original is held between the ball and the opposed member.

In the above-described device, the opposed member may be a keep plate mounted on the apparatus body side or may be a cylindrical roller or a spherical roller. The ball, particularly if provided above the roller, may preferably be a metal ball because a predetermined or greater weight is necessary for the purpose of keeping down the original, but other materials can also be used. The surface of at least one of the ball and the opposed member may advantageously be formed of a material of high friction coefficient to enhance the conveyance force of the original.

With the above-described construction, when the original conveyed toward the guide surface bears against this surface and is about to change its conveyance direction to the direction in which the original is aligned, said ball freely rotates so as not to interfere with the alignment of the original, thus providing a good result.

BEST MODE FOR CARRYING OUT THE INVENTION

To describe the present invention in greater detail, embodiments of the present invention will hereinafter be described with reference to the accompanying drawings.

Figure 1:
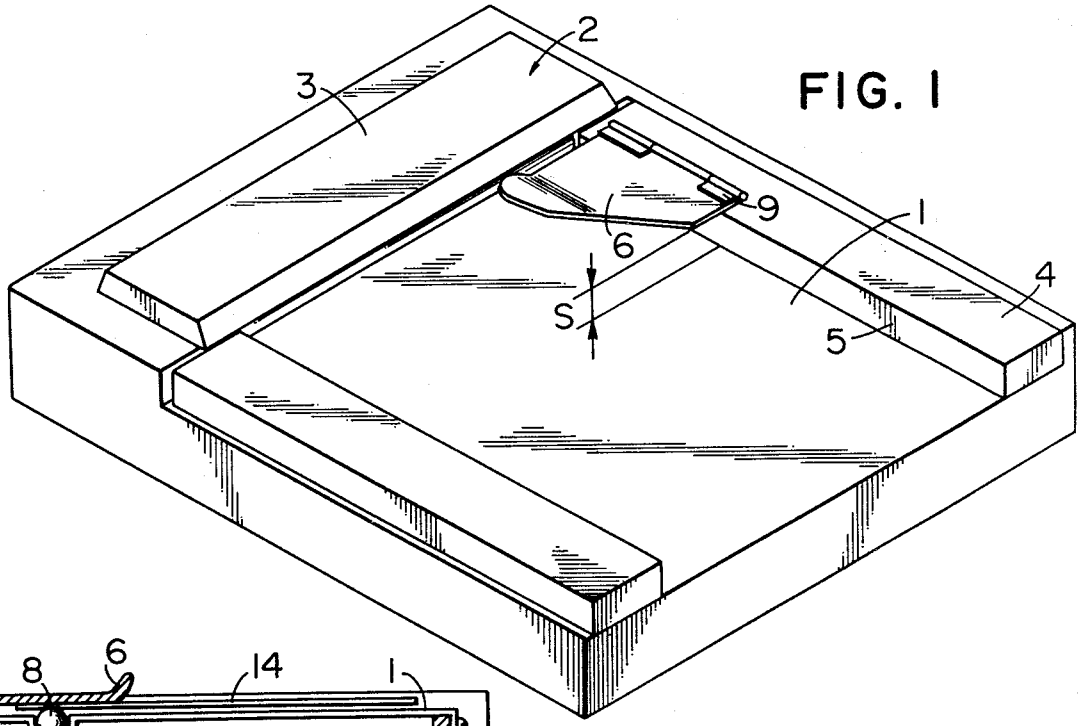
FIG. 1 is a perspective view of a facsimile apparatus to which the present invention is applied.
Figure 2:
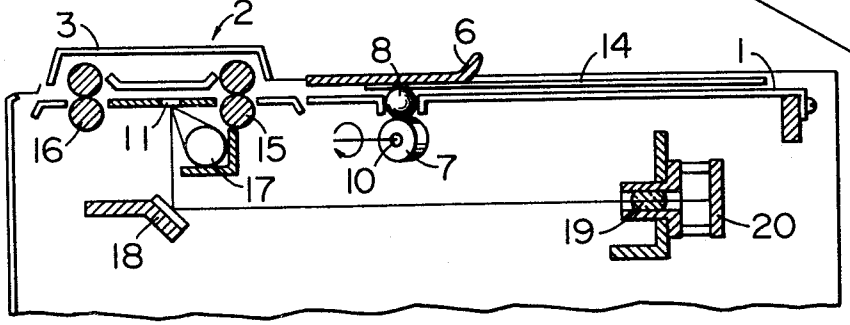
FIG. 2 is a cross-sectional view of the FIG. 1 apparatus taken in the original feeding direction.

FIG. 1 shows the original conveying portion of a facsimile apparatus to which the present invention is applied. In the Figure, reference numeral 1 designates an original supporting surface, reference numeral 2 denotes an original reading portion, and two pairs of conveyor rollers are provided below a cover 3. An original, when passing said reading portion while being held between the rollers, is illuminated by a lamp as shown in FIG. 2, and the image of the original is directed to a photoelectric converting element (CCD) through an optical system and is converted from an optical image into an electrical signal. At the back of the original supporting surface 1 as viewed in the Figure, a guide plate 4 mounted at right angles with the slit direction of said reading portion is fixed. That side of this plate 4 which is adjacent to the original supporting surface 1 constitutes a guide surface 5 for guiding the original being conveyed. Designated by 6 is a keep plate constituting the opposed member of the present invention and below this keep plate 6, as shown in FIG. 2, a metal ball driven by a drive pinch roller 7 is disposed and the original is passed between this ball 8 and the keep plate 6 to effect the alignment of the original. Said keep plate 6 is mounted on the guide plate 4 to the body openably with respect to the original path by hinges 9. The original is urged against the ball 8 by the gravity of this guide plate and, by the ball 8 being rotated as described above, the original is fed toward the guide surface 5. Where the keep plate 6 is light in weight, a coil spring may be attached to the hinges so that the plate 6 is biased toward the ball 8.

Figure 3:
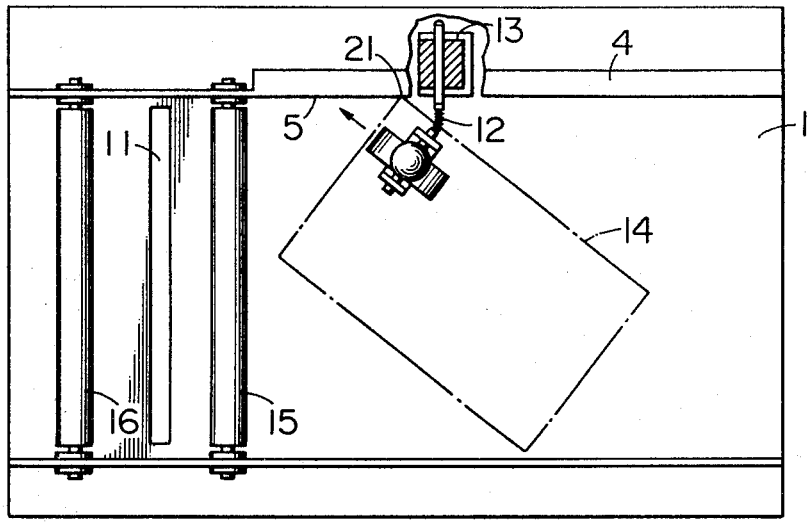
FIG. 3 is a plan view of the original conveying portion of the FIG. 1 apparatus.

Reference is now had to FIGS. 2 and 3 to describe the apparatus construction of the present invention and the process in which the original is aligned. As mentioned above, the ball 8 is driven by the pinch roller 7 and, as shown, this roller 7 has its rotary shaft 10 mounted non-parallel to the direction of the slit 11 of the reading portion 2, and the angle formed by the right angle direction of the shaft 10 with the guide surface is an acute angle of 20°–30°. The shaft 10 is connected to the rotary shaft of a motor 13 which is a drive source, through a universal joint 12 using a coil spring. With the above-described construction, when the motor 13 is rotated clockwisely, the roller 7 is rotated in the direction of arrow and the ball 8 placed on the roller 7 is rotated counter-clockwisely of the roller 7. The ball 8 is disposed at a position projected upwardly by about 0.5–2 mm from the original supporting surface 1. The greater the diameter of the ball 8, the greater the degree of contact with the original and therefore, the conveyance force of the original is enhanced. Also, the ball 8 is supported by the wall surface around the ball 8 and the roller 7 and can therefore be rotated stably to convey stably the original held between the ball 8 and the keep plate 6. In FIGS. 2 and 3, reference numerals 15 and 16 designate rollers for conveying the original while holding it therebetween, reference numeral 17 denotes a lamp for illuminating the original, reference numeral 18 designates a mirror, reference numeral 19 denotes an imaging lens, and reference numeral 20 designates a CCD element.

Description will now be made of the process in which the original is aligned by the above-described driving mechanism. When, as shown in FIG. 3, the original has been fed between the ball 8 and the keep plate 6 with the sides of the original being non-parallel to the reference surface, the ball 8 on the pinch roller 7 is rotated as if it had an axis parallel to the rotational axis of the roller 7. That is, the dot-and-dash line indicated on the ball 8 of FIG. 3 shows the portion of contact thereof with the roller 7 and at the same time, provides the portion of contact thereof with the original 14, and thus moves the original 14 forward in the direction of arrow. The original 14 is conveyed in the direction of arrow until the right side of the leading end of the original strikes against the guide surface 5. Next, when the leading end portion 21 of the original strikes against the guide portion, a drag is created between the original and the guide surface 5 and this drag becomes a component of force related to the angle formed between the propulsion force of the original and the guide surface, and thus the original 14 moves forward while rotating counter-clockwisely about the point of contact thereof with the ball 8. That is, no excessive friction force is created because at least one surface of the original is conveyed by the ball 8 and as described above, in accordance with the component of force created by the original bearing against the guide surface 5, the original moves forward while rotating counter-clockwisely. Further, one of the means for imparting a drive force to the original does not have a rotary shaft and the portion of contact is small and therefore, the original can slide between the ball 8 and the keep plate 6. Thus, even if the original is thin paper like air mail paper, the right side edge of the original can be finally brought to the guide surface without the original being deformed.

By the above-described series of actions, the original 14 whose end portion 21 alone has been in contact with the guide surface 5 has its right side edge gradually brought into contact with the guide surface 5 and now, the ball 8 having no rotational axis and the original slide and the original 14 is conveyed toward the roller 15 along the guide surface. At this time, the leading end edge of the original becomes parallel to the slit 11 of the reading portion and therefore, the original is nipped between the rollers 15 and 16 in its aligned condition. Where the start of the reading must be synchronized with another portion when the original is passed to the slit 11, the roller 15 can be stopped temporally to flex the original between this roller 15 and the aligning means and thereby make the leading end edge of the original further parallel to the slit 11.

To increase the original conveying force of the aligning device in the above-described construction, the diameter of the ball 8 may be increased or the surface of the ball may be provided with rubber or concavo-convexity to increase the friction force thereof. However, if the conveying force at this time is too strong to cause a suitable degree of sliding phenomenon between the ball and the original, the original being conveyed may sometimes be wrinkled or creased and thereby damaged, and such damage of the original would be particularly remarkable when the original is thin.

Another embodiment of the original feeding means of the above-described aligning device will now be explained.

Figure 4:
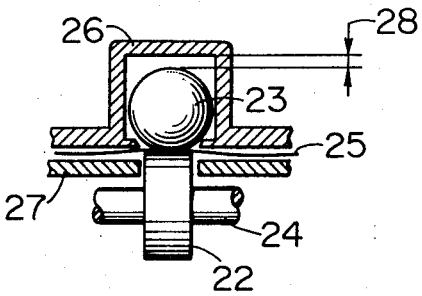
FIGS. 4 to 6 are front views showing the relation between the opposed member and ball of the present invention.

FIG. 4 shows a combination of a driving roller 22 and a ball 23. In the Figure, reference numeral 24 designates the drive shaft of the roller 22, an original 25 is disposed between the roller 22 and the ball 23, and this ball 23 urges the original against the roller 22 to convey the original in accordance with the rotation of the roller 22. In the above-described device, the support of the ball 23 is provided by a plate-like member 26 like the keep plate of FIG. 1, and this member is formed with a concave portion for containing the ball 23 therein. In FIG. 4, reference numeral 27 designates a table for supporting the original 25 thereon, and arrow 28 indicates the space formed between the concave portion and the ball 23. To enhance the original conveying force in the present embodiment, it is effective to process the surface of the roller 22 so as to have a high friction coefficient or increase the weight of the ball 23 itself. Also, where the original is thick, the ball 23 is elevated by an amount corresponding to the space 28 to convey the original. Of course, in the construction as shown in FIG. 1, by making the plate-like member 26 openable with respect to the original supporting table 27, it is possible to feed a thicker original.

Figure 5:
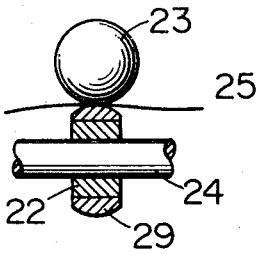

FIG. 5 shows a modification in which the surface of the lower roller 22 shown in FIG. 4 is covered with urethane rubber or the like to provide a spherical surface. In this case, the original can be well conveyed by the surface friction layer 29 and further, the original and the ball 23 and the friction surface 29 make a point contact and therefore, the original can be sufficiently slid between the ball 23 and the friction layer 29, thus ensuring the above-described aligning process to be accomplished.

Figure 6:
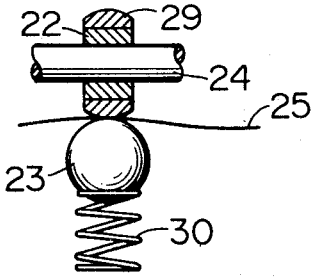

FIG. 6 shows an embodiment in which the positions of the roller 22 of FIG. 5 and the ball 23 urging the original against this roller by its own gravity are reversed. In this embodiment, a coil spring 30 is used to urged the ball 23 against the roller 22.

To prepare the device shown as an embodiment in FIG. 5, a steel ball has been used as the ball, the diameter of this steel ball being $\phi$12 mm(about 7 g) to $\phi$16 mm(about 16.7 g), and urethane foam and urethane rubber have been used as the surface of the lower roller, the portion of the roller which bears against the ball being formed into a spherical shape, and an experiment of feeding an original with the lower roller being rotated at an angle of 20°–30° with respect to the guide surface has been carried out. According to it, a good result in aligning function and conveying function has been obtained for originals from a very thin original such as air mail paper to a thick original of the order of 430 $\mu$m. Also, the height S of the guide surface (FIG. 1) is preferably of the order of 1.5–3 mm. The reason is that, in the case of a thin original such as air mail paper, if said height S is great, the right shoulder portion of the original is liable to be curled when it strikes against the guide surface, and thus a good aligning function cannot be expected. Further, it is desirable that the portions of the original supporting table, the guide surface and the upper surface cover portion of the original supporting table (corresponding to 6 in FIG. 1) which contact the original be formed integrally to eliminate any gap therebetween. The reason is that if there are gaps at these locations, particularly the end edge of a thin original would get into these gaps to cause damage or jam of the paper.

When the device of FIG. 5 has been compared with the device of FIG. 4, the device of FIG. 5 has empirically shown a higher aligning function. What is considered to be the reason therefor is that the portion of the surface of the lower roller which contacts the ball is formed of a high friction member and at the same time, the cross-section thereof depicts a circular arc. It is considered that by this, the original is sufficiently conveyed and where necessary, it is rotated without applying a load. The example of FIG. 5 has exhibited the highest performance among the aligning devices of FIGS. 1 to 6.

In each of the above-described embodiments, the roller and ball are disposed so as to feed the original at an angle of 15°–45° with respect to the guide surface as shown in FIG. 3, and this angle is variable with the quality of paper of the original, but to ensure stable conveyance of thin originals to ordinary originals, said angle should preferably be set to an acute angle of the order of 20°–30°. Also, said aligning device may be provided so that a plurality of such devices act on the original depending on the size and weight of the original.

In the above-described device, the ball and the opposed member are always in contact with each other. Therefore, in order to dispose an original between the ball and the opposed member, the ball side must be raised against the gravity of the ball itself or a spring force or the opposed member side must likewise be raised. As compared with the conventional aligning device of the type in which rollers are opposed to each other, this enables the insertion of an original to be easily effected with a much smaller force, but to further improve the operability, the ball and the opposed member in the device of the present invention are placed in non-contact relationship during the insertion of an original.

That is, before an original is inserted, the gap between the ball and the opposed member such as drive roller is maintained so as to be greater than the thickness of a sheet original and, when the original is inserted, it is detected and the sheet original is conveyed by being nipped between the ball and the opposed member. During this conveyance, the ball is supported so as to be rotatable in any direction within a limited range opposed to the opposed member and, when the end portion of the sheet original strikes against the guide surface and this original receives the drag from the guide surface, the conveyance direction can be easily changed. When the sheet original has been aligned in a predetermined direction with respect to the reading portion and conveyed to a predetermined position, for example, the gap between the ball and the opposed member is again formed, thus becoming ready to receive a next sheet original to be inserted.

Figure 7:
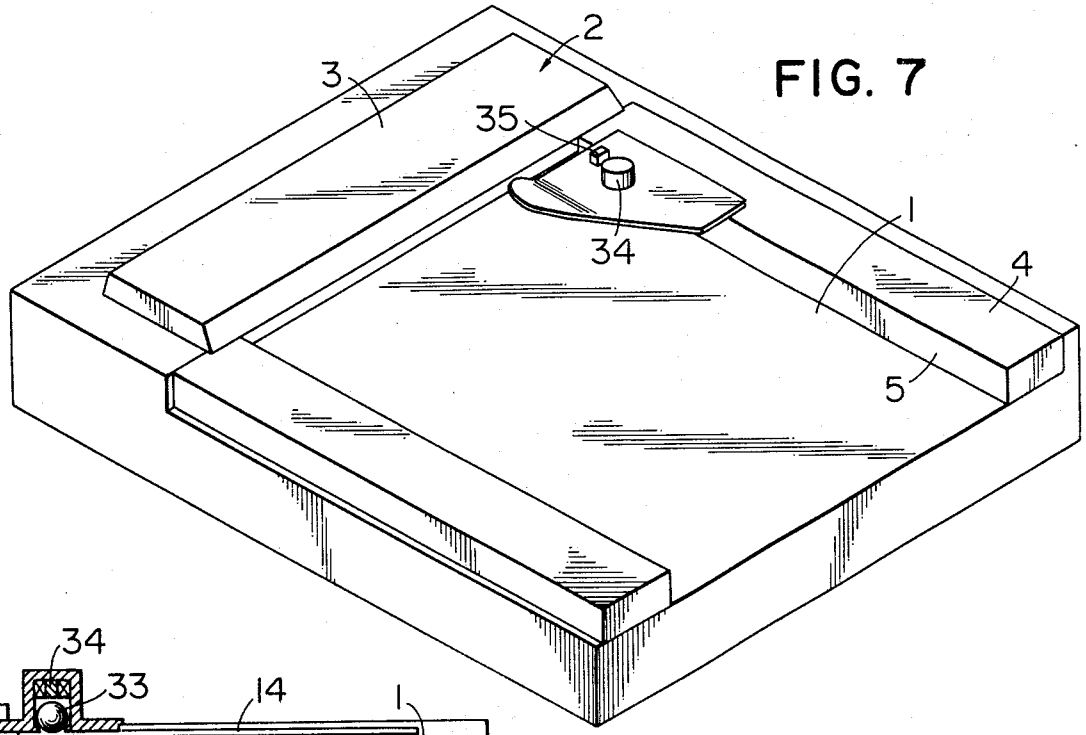
FIG. 7 is a perspective view of a facsimile apparatus to which the present invention is applied.
Figure 8:
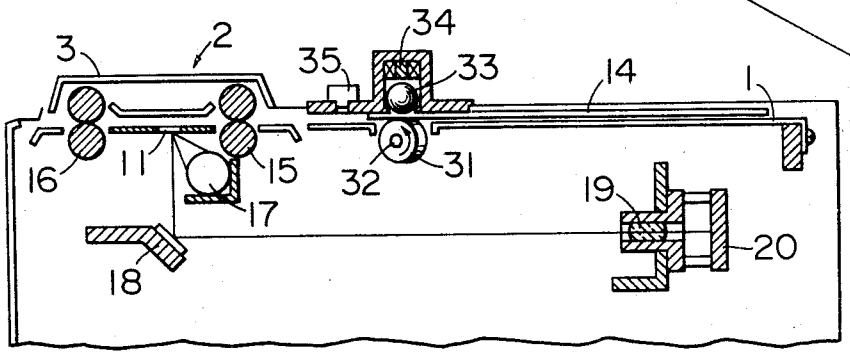
FIG. 8 is a cross-sectional view of the FIG. 7 apparatus taken in the original feeding direction.
Figure 9:
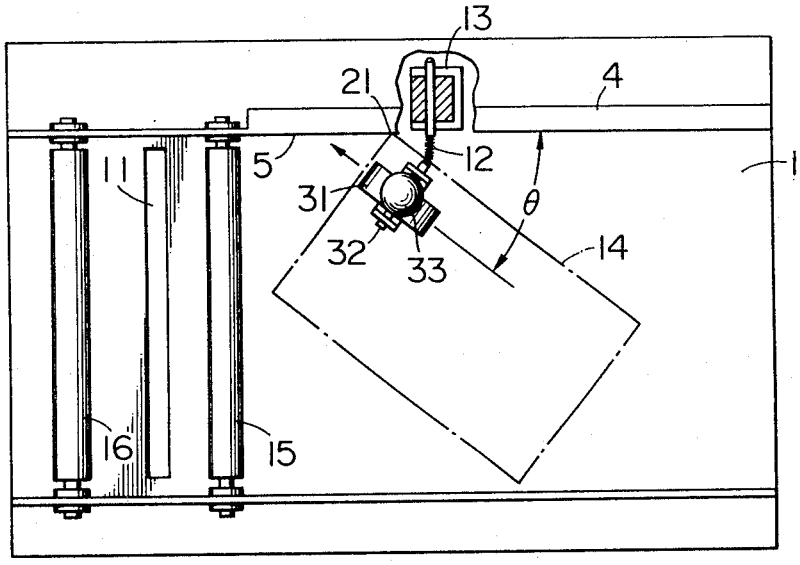
FIG. 9 is a plan view of the original conveying portion of the FIG. 7 apparatus.

FIG. 7 is a perspective view showing the original conveying portion of the facsimile apparatus of the present invention to which the foregoing description has been applied, FIG. 8 is a cross-sectional view of the FIG. 7 apparatus taken in the original feeding direction, and FIG. 9 is a plan view of the FIG. 8 apparatus. Members identical to those in the apparatus construction described in connection with FIGS. 1 to 3 are given identical reference numerals. 31 designates a roller constituting the opposed member of the present invention, and it is driven by a shaft 32 so as to convey an original in the direction of an acute with respect to a guide plate 4. Designated by 33 is a magnetic metal ball which is in contact with the roller 31 during the conveyance of the original. Designated by 34 is an electromagnet for raising the ball 8 to provide a gap between the ball 8 and the roller 7 during non-conveyance. Aligning of the original is effected by passing the original between the ball 33 and the roller 31. Designated by 35 is an original detector for detecting the insertion of the original.

Reference is now had to FIGS. 8 and 9 to describe the apparatus construction of the present invention and the process in which the original is aligned.

In the condition in which the main switch of the facsimile apparatus body has been closed and the insertion of an original is being waited for, the ball 33 has been raised by the electromagnet which is automatically energized by the closing of the main switch and there is created a gap greater than the thickness of the original between the ball 33 and the roller 31. When the original 14 is inserted into said gap, the detector 35 detects the presence of the original and the current to the electromagnet 34 is cut off by a control machanism, not shown, whereby the electromagnet 34 loses its magnetic force to permit the ball 33 to fall onto the roller 31 and nip the original 14 between the ball and the roller 31. As a result, the roller 31, the rotary shaft 32 of which is mounted non-parallel to the direction of the slit 11 of ller 31. As a result, the roller 31, the rotary shaft 32 of which is mounted non-parallel to the direction of the slit 11 of the reading portion, as shown, the angle $\theta$ formed between the right angle direction of the shaft 32 and the guide surface being an acute angle of 20°–30°, causes the leading end of the original to strike against the guide surface at a predetermined angle. On the other hand, the shaft 32 is connected to the rotary shaft of a motor 13 which is a drive source, through a universal joint 12 using a coil spring. With the above-described construction, when the motor 13 is rotated counter-clockwisely, the roller 31 is rotated in the direction of arrow to convey the original 14 in the direction of arrow indicated in FIG. 9. When the right side 21 of the leading end of the original 14 strikes against the guide surface 5 (FIG. 7) of the guide plate 4, a drag is created between the original and the guide surface 5 and by this drag, the original 14 is moved forward while rotating counter-clockwisely about the point of contact thereof with the ball 8, and is finally nipped between conveyor rollers 15 in a condition in which the right side edge of the original 14 is in contact with the guide surface 5, namely, a condition in which the original has been aligned at a desired angle. In this case, the conveyance force for the original is made intermittent by up and down movement of the ball 33 and therefore, an effect equivalent to the case where a clutch mechanism is inserted between the ball and the drive source of the conveyor rollers 15, 16 can also be provided. Also, when the detector 35 detects no original, the electromagnet 34 is electrically energized to raise the ball 33.

Figure 10:
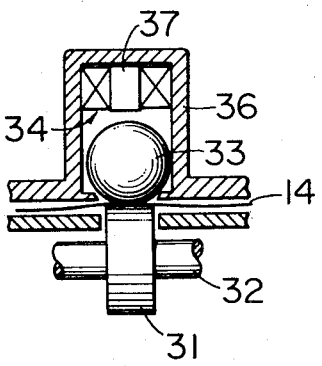
FIG. 10 is a front view showing the ball holding mechanism of the present invention.

A holding mechanism for the ball will now be described with reference to FIG. 10. The ball 33 and the electromagnet 34 are supported by a holder 36. An electromagnet using an ordinary iron core 37 generates no magnetic force when the current thereto is cut off and therefore, the ball 33 falls onto the roller 31 from its own gravity and nips the original 14 disposed between the ball and the roller 31, by the gravity force of the roller 31. When current flows to the coil of the electromagnet, the iron core 37 is magnetized to raise the ball 33 by the magnetic force. At this time, a gap is created between the ball 33 and the roller 31, so that even a very thin original such as air mail paper can be easily inserted without being creased.

In order to magnetize an electromagnet, a great power is usually required. In the original aligning device of the present invention, an original should only be conveyed on the original supporting plate until the original is nipped between the conveyor rollers 15, 16 of the reading portion, and thereafter or during stand-by condition, the original need not be conveyed. That is, the time during which a gap is provided between the ball 33 and the roller 31 is much longer than the time during which the ball is in contact with the roller and therefore, it is more economical to apply a current only when the ball is caused to drop.

Figure 11:
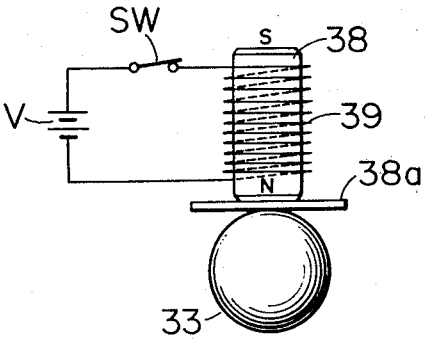
FIG. 11 is a front view of a ball holding mechanism using an electromagnet using a permanent magnet as an iron core.

FIG. 11 is a front view showing an embodiment using an electromagnet using a permanent magnet as the iron core to satisfy the above-mentioned economic requirement. Where the permanent magnet 38 is provided so that, for example, the N pole lies at the ball side, an electromagnetic coil 39 may be wound so that the S pole lies at the ball side. When a current is not flowed at this time, the ball 33 formed of a metal ball is raised by the magnetic force of the permanent magnet 38 to facilitate the insertion of an original and next, when a switch SW is closed and a current is flowed from a power source V, the magnetic force of the electromagnetic coil 39 and the magnetic force of the permanent magnet 38 are offset by each other and the ball 33 falls onto the drive roller from its own gravity. In this construction, when the ball 33 directly contacts the permanent magnet 38, the ball 33 does not readily separate from the permanent magnet 38 even if a current is flowed to the coil and therefore, a member of low magnetic permeability such as paper or a non-magnetic member **38*a* may preferably be provided between the ball 33 and the permanent magnet 38**. The above-described construction serves to positively separate the ball from the magnet even if a balance is not completely held between the magnetic force of the permanent magnet and the electromagnetic force of the coil.

As the detector means for detecting an original in the present invention, use may be made of means usually used as paper detector means, such as microswitch reflection type or transmission type photosensor, ultrasonic sensor or magnetic sensor.

If the ball is so formed of a magnetic material and an electromagnet is used as the mechanism for holding the ball, the release of holding and control of re-holding will become easy and at the same time, the construction can be simplified.

Description will now be made of an improved example of the electromagnet for attracting the above-described ball by an electromagnetic force.

Figure 12:
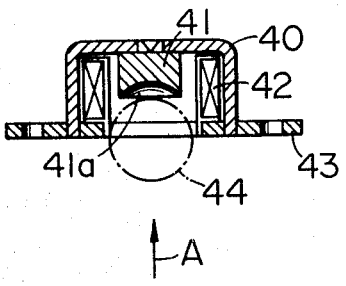
FIG. 12 is a major cross-sectional view of the electromagnet device of the present invention.

FIG. 12 shows a major cross-section of an improved electromagnet. In the Figure, reference numeral 40 designates a yoke, reference numeral 41 denotes an iron core, reference numeral 42 designates a bobbin having a coil wound thereon, and reference numeral 43 denotes a front frame. The Figure shows a condition in which the bobbin 42 has been incorporated in the yoke 40, and the iron core 41 is caulked in the yoke 40, which in turn is caulked in the front frame 43, thereby forming an integral construction. The construction of this electromagnet differs from the prior art one in that the portion of the iron core 41 which contacts a ball 44 has a spherical groove **41*a* complementary to the outside diameter of the ball 44. What this construction means is that as compared with the prior art construction in which the iron core surface contacting the ball is planar, it has an advantage that the magnetomotive force for holding the ball can be made small. That is, by using a closed magnetic circuit comprising the iron core 41, yoke 40, front frame 43 and ball 44, the effective magnetic flux raising and holding the ball 44** becomes great as compared with the construction in which the surface of the iron core which supports the ball is planar.

This will be described with respect to an embodiment. When comparison is made in respect of the magnetomotive force required to raise a steel ball having a diameter of 14.3 mm and a weight of about 11 g by about 1.5 mm, a magnetomotive force of the order of minimum 120 ampere turn is necessary for the construction in which the steel ball supporting portion of the iron core is planar, whereas a magnetomotive force of the order of only 90 ampere turn is required when an iron core having a spherical groove and thus, the magnetomotive force required can be made small by as much as 25%. Also, as empirically confirmed other means for improving the efficiency of the electromagnet, it is effective in terms of the magnetic circuit to minimize the gap T between the hole in the front frame 43 through which the ball 44 passes and the outer diameter of the ball 44, as shown, for example, in FIG. 13 (a view taken in the direction of arrow A in FIG. 12).

Figure 14:
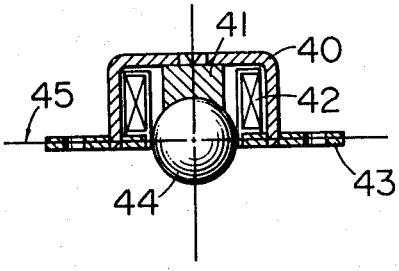
FIG. 14 is a cross-sectional view showing a condition in which the ball has been attracted in FIG. 12.

FIG. 14 shows a condition in which the ball 44 is in contact with the iron core 41, and it seems that the magnetic efficiency becomes higher when design is made such that the center line 45 of the ball 44 in this condition is substantially the center of the plate thickness of the front frame 43. This is a matter of course, but in order to enhance the efficiency of the magnetic circuit, it is more advantageous to utilize a material of high magnetic permeability, for example, electromagnetic soft iron or the like, as the material forming the yoke 40, iron core 41 and front frame 43. It has been confirmed that, even where a cold rolled steel plate (SPC) is used, the residual strain during the processing is removed by using parts subjected to a heat treatment at the order of 800° C. and this is magnetically advantageous.

Figure 13:
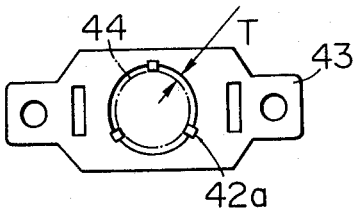
FIG. 13 is a bottom plan view of the FIG. 12 device as seen from the direction of arrow A.
Figure 15:
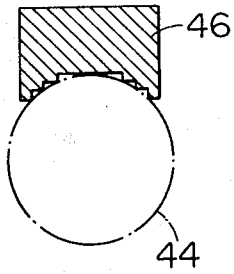
FIG. 15 is a cross-sectional view of the iron core.

As shown in FIG. 13, the guide 42*a* of the bobbin is constructed so as to be somewhat larger than the outer diameter of the ball 44 and smaller than the diameter of the hole in the front frame through which the ball 44 passes. By this, the guide portion 42*a* guides the ball 44 during the up and down operation when the ball 44 is attracted and released with respect to the electromagnet and when the ball 8 is rotated during the conveyance of an original. Accordingly, if this guide 42*a* is made of a material of good sliding property, for example, polyacetal resin or polyamide resin, an unnecessary increase in load such as friction with respect to the movement of the ball 44 could be prevented. Since the bobbin 42 is usually formed of a material having electrical insulativeness, the use of a plastics material as mentioned above also matches this requirement. As regards the concave portion of the iron core, a concave portion not having a completely curved surface but having a number of stepped portions and generally corresponding to the diameter of the ball as shown in FIG. 15 may be formed in the iron core 46.

According to the device of the present invention, as has been described above, the efficiency of the electromagnet can be enhanced more than in the device of the prior art, and such effects as the reduced power consumption of the device, the compactness of the electromagnet device resulting from a reduced number of turns of the coil, and the reduced heating resulting from the reduced power consumption and accordingly the suppression of temperature rise of the device can be obtained.

In the above-described ball supporting mechanism using an electromagnet, it may also happen that the ball 44 does not fall even in a condition in which the current to the electromagnet has been cut off when an original is conveyed. This tendency is particularly remarkable when the current has been cut off after the ball 44 has been held for a long time. A factor which can be considered to be one cause thereof would be that if the ball 44 is held by the electromagnet for a long time, the magnetic ball 44 is magnetized during that time and some residual magnetism still exists in the ball even after the current has been cut off, thereby making it difficult for the ball to separate from the iron core 41 of the electromagnet. This becomes a serious disadvantage in view of the function of the original aligning device, because the original conveying force is not produced if the ball 44 does not fall onto the roller which is the opposed member with an original interposed therebetween.

Figure 16:
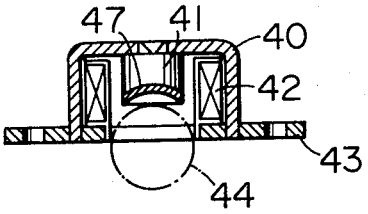
FIG. 16 is a cross-sectional view of essential portions of the electromagnet of the present invention.

FIG. 16 is a major cross-section of an electromagnet portion designed to improve the above-noted disadvantage. In the Figure, reference numeral 47 designates a layer of non-magnetic material which is an important constituent, and it is provided in the form of coating on the surface of the iron core 41 which contacts the ball 44. The purpose of this non-magnetic material layer 47 is to display the effect of causing the ball 44 held by the electromagnet to fall stably when the current to said electromagnet has been cut off. By providing such layer 47, it becomes possible to cause the ball 44 to fall well even when the current is cut off after the ball 44 has been held for a long time.

It has been confirmed in an experiment accompanying the present invention that when a steel ball having a weight of about 11 g and a diameter of 14.3 mm has been used as the ball 44 and said improved electromagnet holds a magnetomotive force of about 90 ampere turn and when, for example, polyester film with a tacky agent having a thickness of the order of 60μ or PTFE (Teflon) film with a tacky agent having a thickness of the order of 100μ has been attached as the non-magnetic material layer 47, the effect thereof is great.

On the other hand, it has been confirmed that under the above-described conditions, copper plating having a thickness of 15μ, urethane paint film having a thickness of the order of 30–40μ and Teflon coat film having a thickness of the order of 25–30μ provide somewhat improved stability of falling of the ball 44 as compared with a case where these substances are not used, but even when such substances are used, the stability of falling after the ball has been held for a long time is sometimes insufficient.

Inferring from the various matters confirmed under the above-noted conditions, a conclusion has been obtained that film of plastics having a thickness of at least 50μ is best suited as the non-magnetic material layer 47 for causing the ball 44 to stably fall under said conditions. One reason therefor is that in order to obtain a coating or the like having a thickness of 50μ or more, it is necessary to apply the substance a plurality of times and a technically high degree of manufacturing facilities must be used to make the coating, but in contrast therewith, plastics film is considered to be suited from the viewpoints of the uniformity of thickness, simplicity of manufacture and cost. Plastics film having a thickness of the order of 50–100μ would be readily available in the market and would therefore make it easy to carry out the present invention.

As the aforementioned non-magnetic material layer, in addition to the above-mentioned polyester film and PTFE (Teflon) film, use may be made of a substance such as vinyl chloride film, polyamide film or polyethylene film which is ordinary plastics film. Other usable non-magnetic materials include non-magnetic metals such as aluminum, brass, copper, phosphor bronze, etc., in addition to the above-described resins.

As another embodiment of the present invention, hairs of plastics (for example, polyamide) having a length of the order of 0.1 mm, for example, may also be planted as the non-magnetic material layer on the surface of the iron core which attracts the ball, to thereby obtain a similar effect.

In FIG. 16, the surface of the iron core 41 which contacts the ball 44 presents a spherical shape corresponding to the outside diameter of the ball 44 and this is for the purpose of enabling the magnetomotive force with which the spherically grooved iron core attracts the ball to be efficiently generated, and this spherical shape of that surface cannot be a restrictive condition of the present invention but a planar surface may also result in a similar effect.

Figure 17:
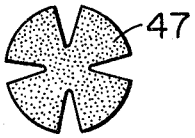
FIG. 17 is a plan view of film showing an example of the formation of the non-magnetic material layer of the present invention.

As regards the shape of the non-magnetic material layer 47 provided on the iron core 41 of the FIG. 16 embodiment having a spherical groove, this shape may be rendered into the shape as shown in FIG. 17 wherein a circular film is provided with a plurality of radial notches, whereby the layer 47 can be set to a condition substantially complementary to the spherical groove of said iron core 41.

Figure 18:
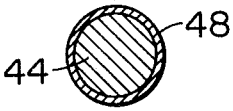
FIG. 18 is a cross-sectional view of a ball showing another embodiment of the present invention.

FIG. 18 shows another embodiment of the present invention in which, conversely to the hitherto described embodiments, a non-magnetic material layer 48 is provided on the outer side of the ball 44. Again in this case, when the ball 44 is held by the electromagnet, said effect of the present invention can be obtained because the non-magnetic material layer is formed between the ball and the surface of the iron core 41 which contacts the ball.

According to the present invention, as described above, by adding a slight member, the attraction between the electromagnet and the ball formed of a magnetic material and the falling of the ball can be very stably effected, thus greatly enhancing the reliability as the original aligning device.

In the device of the embodiment shown in FIGS. 7 to 10, the ball 33 is normally attracted to the electromagnet 34 when the original 14 is not inserted between the ball 33 and the roller 31. Thus, a current is supplied to the electromagnet 34 even when no original is being conveyed, and this means a slight consumption of the power. Also, as described with respect to the embodiment of FIG. 16, there is a possibility of causing such an accident that the ball 33 cannot smoothly fall when the power supply has been cut off during the conveyance of an original.

Figure 19:
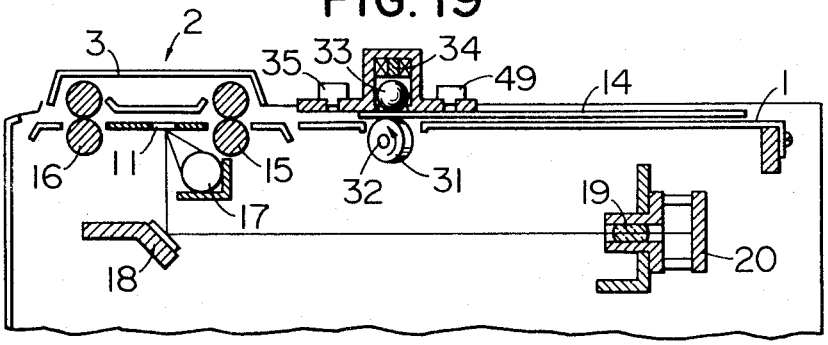
FIG. 19 is a cross-sectional view of a facsimile apparatus improved in the power supply timing to the electromagnet, taken in the original feeding direction.

A method of solving this problem will be described with reference to FIG. 19 which is a cross-section of the device. In the Figure, reference numeral 49 designates an original detector further added to the device of FIG. 8. In the device of FIG. 19, the ball 33 normally falls on the roller 31. When an original 14 is inserted into the aligning device, the insertion of the original 14 is first detected by the detector 49 and power is supplied to the electromagnet 34 by the detection signal, to rotate the roller 32. Upon said power supply, the ball 33 is attracted to the magnet 34 to open the insertion path to thereby enable the original 14 to be readily directed into the space formed between the roller 31 and the ball 33.

When the original 14 is further inserted, the next detector 35 detects the leading end of the original and stops the power supply to the electromagnet 34. By this, the ball falls onto the roller 31 with the original interposed therebetween and starts the original aligning action. The driving of the roller 31 may be started at this point of time. The driving of the roller 31 may be stopped after it has been rotated for a sufficient time to convey the original to the rollers 15, or may always be stopped when the detector 35 does not confirm the presence of the original. When the rotation of the roller 31 is so continued for a predetermined time, it can be controlled by the use of time means. The power supply to the electromagnet 34 is not effected until the next original is detected by the detector 49. Accordingly, it becomes possible to minimize the power supply time to the electromagnet as compared with the device of FIG. 8, and thus prevent the remaining of the ball or the electromagnet mentioned in connection with the embodiment of FIG. 16.

As a construction for obtaining a similar effect, the detector 35 is eliminated and only the detector 49 is used so that when this detector 49 detects an original, power is supplied to the electromagnet 34 to raise the ball and facilitate the introduction of the original. After a predetermined time has elapsed, the power supply is stopped to cause the ball to fall onto the original 14 on the roller 31. This predetermined time is determined in connection with the time whereat the original is inserted from the detector 49 onto the roller 31. Also, the setting of this time can be easily effected by timer means. The control of rotation of the roller 31 at this time may be identical to the example shown above. The driving of the roller 31 at this time is continued until at least the leading end of the original comes to the rollers 15.

Next, with regard to the construction for keeping the opposed member and the ball out of contact until an original is inserted, description will be made of an embodiment other than the embodiments in which the ball is attracted by the electromagnet.

Figure 20:
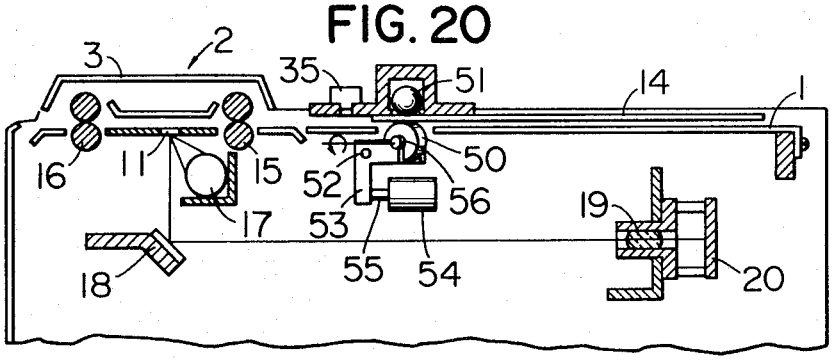
FIG. 20 is a side view of the original conveying portion.

FIG. 20 shows a cross-section of an embodiment of the aligning device having a construction in which the level of the roller is displaced with respect to the ball rotatable at a location. In FIG. 20, parts common to those of FIG. 8 are given identical reference characters.

In the Figure, reference numeral 50 designates a roller designed to be elevated and lowered relative to a ball 51. The roller 50 is rotatively driven by a shaft 52 in a direction to convey an original at an acute angle with respect to a guide plate 4 and is incorporated on a lever 53 for rotation about the shaft 52. In this manner, the lever 53 is rockable on the fixed shaft 52 and has one end coupled to the attracting shaft 55 of an attracting plunger 54. Designated by 51 is the ball having no rotational axis which, when driven, is rotatable following the movement of the drive source side and which contacts the roller 50 with an original 14 interposed therebetween during operation. Designated by 35 is a paper detector for detecting the insertion of an original between the ball and the roller.

Figure 21:
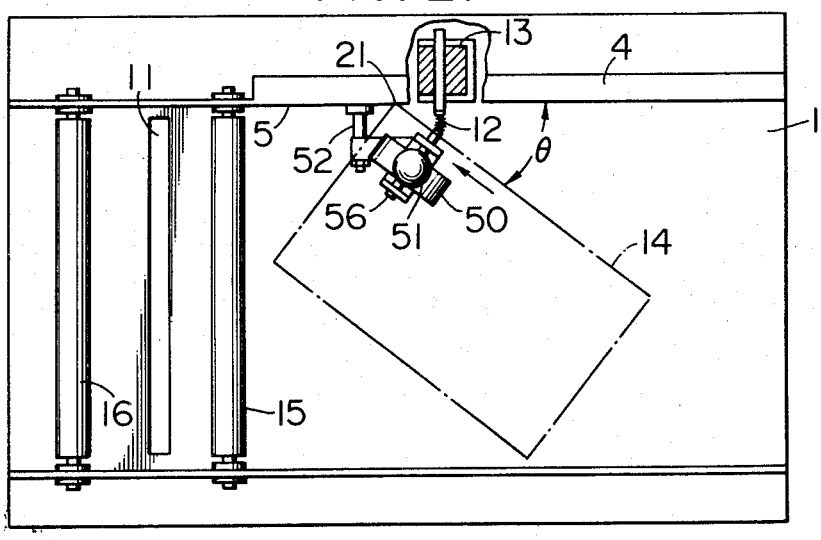
FIG. 21 is a plan view thereof.

The device construction of the present invention and the process in which an original is aligned will now be described with reference to FIG. 20 which is a cross-sectional view of the facsimile apparatus and FIG. 21 which is a plan view of the apparatus. In the standby condition before an original is conveyed, the roller 50 is retracted from the original supporting surface 1 by its own gravity and a gap greater than the thickness of the original is formed between the roller 50 and the ball 51. When the original 14 is inserted into this gap, the paper detector 35 detects the presence of the original and produced a signal by a control circuit (not shown), and the attracting shaft 55 of the plunger 54 is retracted rightwardly. By this, the lever 53 is rotated counter-clockwisely about the fixed shaft 52 as viewed in FIG. 20, and the roller 50 jumps out from the original supporting surface and is elevated to a position in which it somewhat raises the ball 51, and holds the original 14 between itself and the ball. The ball 51 is designed so as not to fall below a certain predetermined position by the convex portion of the supporting portion. The roller 50, as shown, has its rotary shaft 56 mounted non-parallel to the direction of the slit 11 of the reading portion 2, and the angle $\theta$ formed by the right angle direction of the shaft 56 with the guide surface is an acute angle of 20°–30°. The shaft 56 is connected to the rotary shaft 13 of a motor which is a drive source, through a universal joint 12 using a coil spring or through a belt to be described. With the above-described construction, when the motor is rotated, the roller 50 is rotated in the direction of arrow and the original 14 is conveyed in the direction of arrow indicated in FIG. 21. The right side 21 of the leading end of the original 14 bears against the guide surface 5 of the guide plate 4 and a drag is created between the original and the guide surface 5, and by this drag, the original 14 is moved forward while rotating counter-clockwisely about the point of contact thereof with the ball 51, and is finally nipped between the conveyor rollers 15 in a condition in which the right side edge of the original 14 is in contact with the guide surface 5, namely, a condition in which the original has been aligned at right angles with respect to the slit.

An embodiment of the holding mechanism of the roller portion will now be described in detail.

Figure 22:
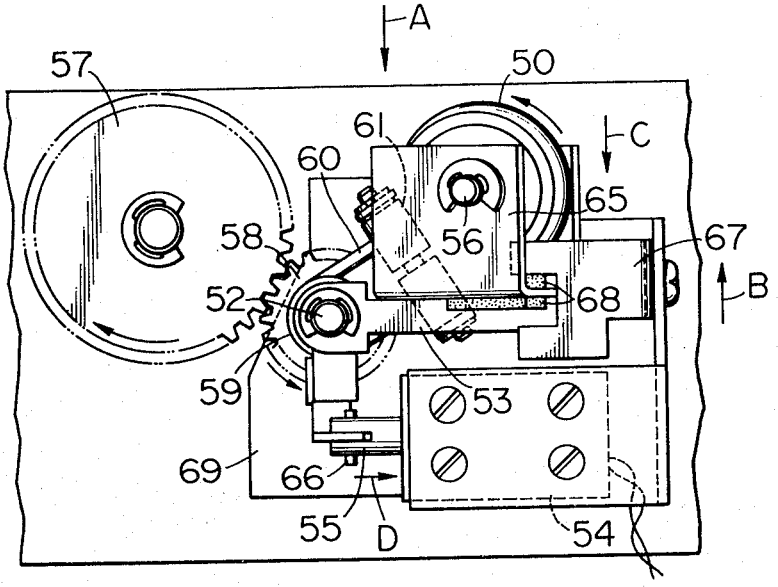
FIG. 22 is a side view showing the holding mechanism of the roller portion shown in FIGS. 20 and 21.
Figure 23:
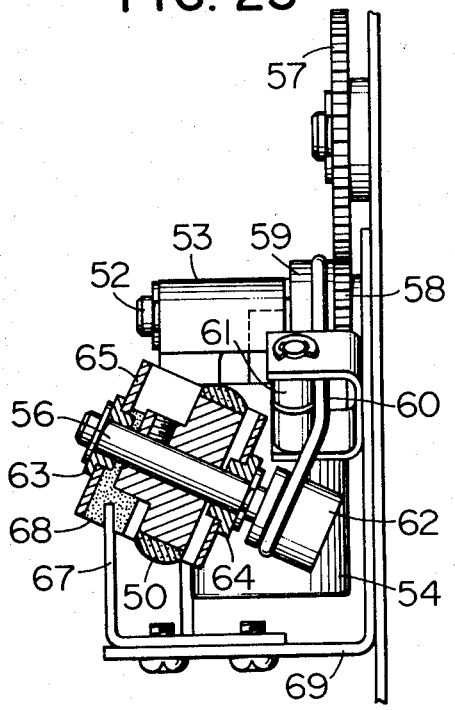
FIG. 23 is a plan view taken in the direction of arrow A of FIG. 22.

FIG. 22 is a side view of the roller portion holding mechanism, the upper side of the FIG. being the original supporting surface, and FIG. 23 is a plan view taken along arrow A in FIG. 22.

A gear 57 is the gear of the drive source side and is rotated clockwisely as viewed in FIG. 22. A gear 58 meshing with the gear 57 is rotated counterclockwisely on said fixed shaft 52, and a pulley portion 59 integral with the gear 58 is also rotated in the same direction. A rubber belt 60 is stretched over the pulley portion 59 and trained over a pulley 62 on the roller shaft 56 by way of a pulley 61 for changing the direction of the belt on its way. This pulley 62 is secured onto the roller shaft 56 and further, the roller 50 is secured onto the roller shaft 56, and the roller 50 is rotated counterclockwisely as viewed in FIG. 22 by the power transmission of the rubber belt 60. This direction is the same as said direction in which the original is fed. By selecting the diameters of the gear 57, gear 58, pulley 59, pulley 62 and roller 50, the peripheral speed of the roller 50 can be set arbitrarily, thus making adjustable the speed at which the original is fed to said infeed rollers 15.

The roller shaft 56 is rotatably journalled by bearings 63 and 64 which in turn are supported by holders 65. Further, a lever 53 supports the entire roller portion and is rotatable about the fixed shaft 52. On the other hand, the other end of the lever 53 is coupled to the attracting shaft 55 of the plunger 54 by a pin 66. Designated by 67 is a plate for regulating the up and down movement stroke of the roller. This plate is designed such that if it is moved in the direction of arrow B, the roller 50 is elevated high. Designated by 68 is a shock absorbing material such as rubber for absorbing the shock during the contact of the regulating plate 66 with the holder 65, and designated by 69 is a base plate on which these series of parts rest.

The operation of the roller holding mechanism of the above-described construction will now be described with reference to the drawings. In the shown stand-by condition, the roller 50 is lowered in the direction of arrow C by its own gravity and lies at stand-by position, with the outside diameter portion of the roller being retracted from said original supporting surface. At this time, the roller portion may be biased downwardly by the use of a spring as required.

When an original is inserted as already described and the original is detected by the paper detector 35, a signal from a control circuit enters the plunger 54, so that the attracting shaft 55 of the plunger is pulled in the direction of arrow D and the lever 53 coupled thereto is rotated counter-clockwisely (FIG. 22) about the fixed shaft 52 and the roller 50 somewhat jumps out from the original supporting surface, thus providing a conveyor device. The amount of this jump-out is adjustable by the regulating plate 67 as described above. However, the experiment shows that the amount of this jump-out may preferably be of the order of 0.5–2 mm for the conveyance of the original. During the upward movement of this roller, the driving gear 57 may always be rotated or powerup may be effected at the point of time whereat the paper detector detects the paper. When the roller 50 is moved up in this manner, the upper peripheral surface of the roller 50 somewhat raises the ball 51 which does not fall beyond a predetermined amount, in the manner as shown in FIG. 4, and conveys the original present between this roller 50 and the ball 51 in a direction to align the original.

As described above, the present invention is a device in which an original is held between a ball and a roller opposed thereto and thereby the original is aligned and in which a gap is provided between the ball and the opposed member during insertion of the original to thereby enable the insertion of the original to be simply accomplished and thus, the present invention facilitates the handling of the original by the user and particularly enables even very thin originals to be positively aligned.

Figure 24:
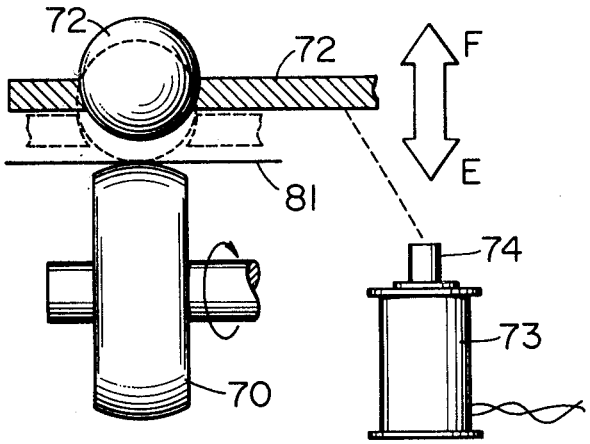
FIG. 24 is a front view of an aligning device showing an embodiment in which the ball is moved up and down to provide a distance between the ball and the opposed member.

The next embodiment of FIG. 24 is one in which a ball is moved up and down relative to a fixed roller. In the Figure, reference numeral 70 denotes a driving roller which performs a function similar to that of the roller 31 of FIG. 8, and reference numeral 71 designates a ball supported on a support 72 in the manner as shown, namely, by being place in a opening having an inside diameter somewhat smaller than the diameter of the ball. In the device of the present embodiment, prior to the insertion of an original, the support 72 lies at its solid-line position to form a gap between the roller 70 and the ball 71 and thereby facilitate the insertion of an original.

During the insertion of an original 81, when the presence of the original has been confirmed by the detector 35 described in connection with FIG. 8, a current is applied to a plunger 73 to attract an attracting shaft 74 in the direction E. Thereby, the support 72 is lowered to its broken-line position, so that the ball 71 comes to rest on the roller 70. At this time, the amount of toward movement of the support 72 is set to a value greater than the amount of downward movement of the ball 71 and therefore, the opening portion of the support comes into contact with the peripheral surface of the ball having a smaller diameter and thus, the ball 71 becomes freely rotatable relative to the rotation of the roller.

The power supply to said plunger is continued as long as the detector 35 of FIG. 8 detects the presence of the original, and thereafter is stopped. When the power supply is stopped, the support 72 so far biased in the direction of arrow returns to its solid-line position. The biasing means may be a coil spring or the like which normally pushes up or pulls up the support 72. The roller 70 may be rotatively driven as long as the detector 35 detects an original. The supporting of the ball may be in the form of point contact, instead of line contact, to reduce the friction force with the support.

Figure 25:
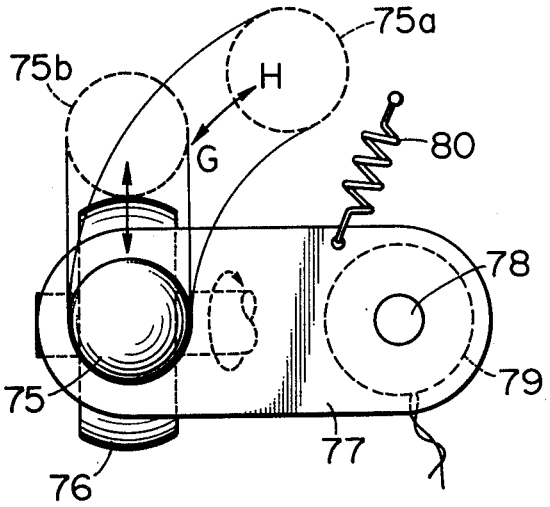
FIG. 25 is a plan view of an aligning device showing an embodiment in which the ball is moved on a plane to provide a distance between the ball and the opposed member.

FIG. 25 shows an embodiment in which a ball 75 is not moved up and down relative to a roller 76 but is moved on a plane. A first example is one in which the support 77 of the ball is rotated about a shaft 78. In the present embodiment, the ball 75 is fixed at the level of the broken line of FIG. 24 relative to the roller 76. When the insertion of an original is waited for, the ball lies at the position of broken line 75*a*. When an original is inserted and the detector 35 described in connection with FIG. 8 detects the presence of the original, power is supplied to a rotary plunger 79 mounted on the rotary shaft 78 and this plunger 79 rotates the support 77 in counter-clockwise direction G against the force of a spring 80 to set the support at its solid-line position. By this, the conveyance of the original for aligning the original is started.

When the original becomes absent from the detector 35, the power supply to the plunger 79 is stopped and the support 77 is rotated in the direction of arrow H by the spring force to return to its start position.

A second example is one in which the support of the ball is parallel-moved instead of being rotationally moved, and in this case, an attracting plunger may be used. In this case, during the insertion of an original, the ball 75 lies at the position of broken line 75*b* and during the alignment conveyance, the ball is moved to its solid-line position. The ball 75 is moved in the conveyance direction of the original, whereby the ball is moved on the original and disposed at its solid-line position, thus reducing the probability of damaging the original.

Again in said embodiment in which the ball is moved on a plane, as in the embodiment of FIG. 24 in which the ball is moved up and down, the plunger may be driven only during the conveyance of an original, thus minimizing the amount of power consumed. Also, no electromagnet is used to more the ball up and down and therefore, the material of the ball is not limited. Further, design may be made such that, when the insertion of an original is waited for, the keep plate 6 of FIG. 1 is raised somewhat above the level of the ball and such raising force is removed by detecting the presence of the original, so that the keep plate 6 rests on the ball.

We claim:

1. An original aligning device for automatically aligning sheet-like originals of various thicknesses in a predetermined direction so that, when an original is conveyed to a reading portion for reading image information of the original, the original is fed in the predetermined direction with respect to said reading portion, characterized by a single ball (8, 23, 33, 44, 51, 71, 75) having no particular rotation axis and which, when it receives an external drive force, rotates in accordance with said drive force, a roller member (22, 29, 50, 70, 76) disposed below said single ball and having a surface on which said single ball bears by its own weight for holding a sheet original (14, 25, 81) between it and said ball, an original guide surface (5) provided in a direction at right angles with respect to said reading portion (11), means (7, 10, 13, 24, 32, 60) for driving said roller member in a direction such that the original conveyed by the cooperation of said ball and said roller member bears against said guide surface, and conveyor means (15) positioned downstream of said ball and roller member for conveying the sheet original to said reading portion, said conveyor means being stopped during the initial feeding of the sheet original to prevent conveying thereof to said reading portion, thereby facilitating the alignment of the sheet original in the predetermined direction by the driving of said roller member.

2. An original aligning device according to claim 1, characterized in that said device has means (34, 38, 39, 41, 46, 54, 73, 79) for forming a gap between said ball and said roller member when the original is inserted between said ball and said opposed member.

3. An original aligning device according to claim 2, characterized in that said gap forming means forms the gap by moving said ball relative to the surface of said roller member.

4. An original aligning device according to claim 2, characterized in that said gap forming means forms a gap by moving said roller member relative to said ball.

5. An original aligning device for automatically aligning sheet-like originals of various thickness in a predetermined direction so that, when an original is conveyed to a reading portion for reading image information of the original, the original is fed in the predetermined direction with respect to said reading portion, characterized by a single ball (8, 23, 33, 44, 51, 71, 75) having no particular rotation axis and which, when it receives an external drive force, rotates in accordance with said drive force, a roller member (22, 29, 50, 70, 76) for holding a sheet original (14, 25, 81) between it and said ball, an original guide surface (5) provided in a direction at right angles with respect to said reading portion (11), means (7, 10, 13, 24, 32, 60) for driving one of said ball and said roller member in a direction such that the original conveyed by the cooperation of said ball and said roller member bears against said guide surface, magnetic means (34, 38, 41, 46) for forming a gap between said ball and said roller member when the original is inserted between said ball and said roller member by a magnetic force, and conveyor means (15) positioned downstream of said ball and roller member for conveying the sheet original to said reading portion, said conveyor means being stopped during the initial feeding of the sheet original to prevent conveyance thereof to said reading portion, thereby facilitating the alignment of the sheet original in the predetermined direction by the driving force applied thereto.

6. An original aligning device according to claim 5, characterized in that a non-magnetic member (38*a*, 47, 48) is interposed between said magnetic means and said ball.

7. An original aligning device according to claim 5, characterized in that said magnetic means is constituted by an electromagnet to which power is supplied to raise said ball and form a gap and, when original detector means (35) provided in a conveyance path downstream of said magnetic means detects the original, the power supply is stopped to cause said ball to fall onto said roller member with the original interposed therebetween.

8. An original aligning device according to claim 5, characterized in that said magnetic means is an electromagnet and original detecting means (35, 49) are disposed in a conveyance path upstream and downstream of said electromagnet and, when the upstream detecting means (49) detects the original, a power is supplied to said electromagnet to raise said ball from said roller member and, when the downstream detecting means (35) detects the original, the power supply to said electromagnet is stopped to cause said ball to fall onto said roller member with the original interposed therebetween.

9. An original aligning device for automatically aligning sheet-like originals of various thicknesses in a proper direction so that, when an original is conveyed to a reading portion for reading image information of the original, the original is fed in a predetermined direction with respect to said reading portion, characterized by a single ball (8, 23, 33, 44, 51, 71, 75) having no particular rotational axis and which, when it receives an external drive force, rotates in accordance with said drive force, a roller member (22, 29, 50, 70, 76) for holding a sheet original (14, 25, 81) between it and said ball, an original guide surface (5) provided in a direction at right angles with respect to said reading portion (11), means (7, 10, 13, 24, 32, 60) for driving one of said ball and said roller member in a direction such that the original conveyed by the cooperation of said ball and said roller member bears against said guide surface, electromagnetic means (34, 41, 46) for forming a gap between said ball and said roller member when the original is inserted between said ball and said roller member by a magnetic force, said electromagnetic means having a recessed portion (41*a*) corresponding to the outside diameter of said ball, and conveyor means (15) positioned downstream of said ball and roller member for conveying the sheet original to said reading portion, said conveyor means being stopped during the initial feeding of the sheet original to prevent conveyance thereto to said reading portion, thereby facilitating the alignment of the sheet original in the predetermined direction by the driving force applied thereto.

10. An original aligning device according to claim 9, characterized in that a non-magnetic member (38*a*, 47, 48) is interposed between said electromagnetic means and said ball.

* * * * *